US011286872B2

(12) United States Patent
Joseph et al.

(10) Patent No.: US 11,286,872 B2
(45) Date of Patent: Mar. 29, 2022

(54) METHOD FOR DETECTING PHYSICAL STOPPAGE OF AN ENGINE

(71) Applicants: CONTINENTAL AUTOMOTIVE FRANCE, Toulouse (FR); CONTINENTAL AUTOMOTIVE GMBH, Hanovre (DE)

(72) Inventors: Fabien Joseph, Castanet Tolosan (FR); Stéphane Eloy, Tournefeuille (FR)

(73) Assignees: CONTINENTAL AUTOMOTIVE FRANCE, Toulouse (FR); CONTINENTAL AUTOMOTIVE GMBH, Hannover (DE)

( * ) Notice: Subject to any disclaimer, the term of this patent is extended or adjusted under 35 U.S.C. 154(b) by 68 days.

(21) Appl. No.: 16/956,388

(22) PCT Filed: Dec. 11, 2018

(86) PCT No.: PCT/FR2018/053193
§ 371 (c)(1),
(2) Date: Jun. 19, 2020

(87) PCT Pub. No.: WO2019/122594
PCT Pub. Date: Jun. 27, 2019

(65) Prior Publication Data

US 2020/0362786 A1 Nov. 19, 2020

(30) Foreign Application Priority Data

Dec. 21, 2017 (FR) ..... 1762692

(51) Int. Cl.
*F02D 41/22* (2006.01)
*F02D 35/02* (2006.01)
*F02D 41/26* (2006.01)

(52) U.S. Cl.
CPC ..... *F02D 41/22* (2013.01); *F02D 35/023* (2013.01); *F02D 41/26* (2013.01)

(58) Field of Classification Search
CPC ..... F02D 35/023; F02D 41/22; F02D 41/26; F02D 41/042
See application file for complete search history.

(56) References Cited

U.S. PATENT DOCUMENTS 9,394,872 B2 7/2016 Howell et al.
9,694,809 B2 7/2017 Ang et al.
(Continued)

FOREIGN PATENT DOCUMENTS

CN 102272433 A 12/2011
CN 104421005 A 3/2015
(Continued)

OTHER PUBLICATIONS

International Search Report, dated Apr. 23, 2019, from corresponding PCT application No. PCT/FR2018/053193.
(Continued)

*Primary Examiner* — Sizo B Vilakazi
*Assistant Examiner* — Anthony L Bacon
(74) *Attorney, Agent, or Firm* — Nixon & Vanderhye

(57) ABSTRACT

Disclosed is a method for detecting physical stoppage of an internal combustion engine, including: at least four cylinders, a set of cylinder pressure sensors, configured such that, over the course of a combustion cycle of the engine, there is at least one cylinder in the compression or expansion phase whose pressure is measured by a pressure sensor of the set, the method including the following steps: measuring the pressure in a cylinder in the compression or expansion phase, calculating, from the pressure measured in the cylinder, a ratio between a pressure variation in the cylinder and the pressure in the cylinder, and detecting a physical stop-
(Continued)

page of the engine if the measured pressure is decreasing and if the calculated ratio is constant.

20 Claims, 4 Drawing Sheets

(56) References Cited

U.S. PATENT DOCUMENTS

| | | | | |
|---|---|---|---|---|
| 2003/0188714 | A1 | 10/2003 | Yamamoto et al. | |
| 2012/0047997 | A1 | 3/2012 | Esteghlal et al. | |
| 2015/0000635 | A1* | 1/2015 | Nishio | F02D 19/023 123/332 |

FOREIGN PATENT DOCUMENTS

| | | | |
|---|---|---|---|
| CN | 105484877 | A | 4/2016 |
| DE | 10 2004 045 153 | A1 | 3/2006 |
| DE | 10 2010 040 843 | A1 | 3/2011 |
| JP | 2005-201197 | A | 7/2005 |
| JP | 2009-138662 | A | 6/2009 |
| WO | 2015/153448 | A1 | 10/2015 |

OTHER PUBLICATIONS

Office Action issued in Chinese Patent Application No. 201880082556.6 dated Dec. 7, 2021.

* cited by examiner

METHOD FOR DETECTING PHYSICAL STOPPAGE OF AN ENGINE

BACKGROUND OF THE INVENTION

Field of the Invention

The invention relates to a method for detecting physical stoppage of an internal combustion engine. It applies in particular to engines comprising at least four cylinders.

Description of the Related Art

The starting of an internal combustion engine is conventionally facilitated by a starter, which comprises a shaft equipped with a pinion that allows the engine to begin to turn over by engaging with a pinion borne by this engine.

During a, possibly brief, stoppage of the engine, it is necessary to determine that the engine has completely stopped before it can be restarted. This is because if the engine has not completely stopped when the starter is actuated, the engaging of the pinions may damage the engine and the starter.

In order to determine a stopped status of the engine, it is known practice to make use of the data acquired by an engine crankshaft rotation sensor, as disclosed for example in document JP2009138662. This sensor is positioned facing a toothed target secured to the crankshaft, and detects the teeth of the target as they file past when this target is rotationally driven, typically by detecting the rising or falling front of each tooth.

Engine stoppage is detected after a timeout of 300 ms, starting from the last tooth detected. If a new tooth is detected before the timeout elapses, the timeout is interrupted and the engine is considered to be in motion.

This solution has a number of drawbacks. Firstly, it entails systematically waiting for the end of the timeout, namely 300 ms, in order to detect an engine stoppage, and therefore in order to authorize the restarting of the engine. Now, it is desirable to be able to restart the engine as soon as possible, for example in vehicles fitted with "stop and start" devices or similar for stopping and automatically restarting the engine of a vehicle, for example in circumstances in which the driver is said to have changed his mind (for example in the case of arriving at a red light which turns to green just at the moment of stopping).

In addition, the toothed targets mounted on engine crankshafts have a spacing of at least 6° between two consecutive teeth. As a result, if there is still in particular some engine movement that is contained within this angular amplitude of 6°, this movement will not be detected. Thus, this mode of detection does not allow engine stoppage to be concluded with certainty.

SUMMARY OF THE INVENTION

It is an object of the invention to alleviate the disadvantages of the above-described prior art.

In particular, one object of the invention is to allow a physical stoppage of the engine to be detected within a timeframe of less than 300 ms.

Another object of the invention is to allow stoppage of the engine to be detected with certainty.

In this regard, one subject of the invention is a method for detecting physical stoppage of an internal combustion engine comprising:

at least four cylinders, a set of cylinder-pressure sensors, which is configured so that throughout an engine combustion cycle, there is at least one cylinder in the compression or expansion phase the pressure of which is measured by a pressure sensor of the set, the method comprising the following steps:

the pressure in a cylinder in the compression or expansion phase is measured, a ratio between a variation in pressure in the cylinder and the pressure in the cylinder is calculated from the pressure measured in the cylinder, and a physical stoppage of the engine is detected if the measured pressure is decreasing and if the calculated ratio is constant.

Advantageously, but optionally, the method according to the invention may furthermore comprise at least one of the following features:

the step of measuring the pressure in a cylinder may comprise the acquisition of pressure values at an acquisition frequency greater than or equal to 1 kHz, and the smoothing of the acquired values.

the step of calculating the ratio between a variation in pressure in the cylinder and the pressure in the cylinder may involve calculating, over a period T, the quantity $$\frac{\Delta P(T_{N+1})}{P(T_{N+1})} = \frac{[P(T_N) - P(T_{N+1})]}{P(T_{N+1})}$$

and comparing said quantity with high and low values, so that if the values of said quantity are comprised between said high and low values then said quantity is considered to be constant.

a physical stoppage of the engine may be detected when the quantity ΔP/P is comprised between the high and low values, and the pressure is decreasing over a determined duration, it being possible for said determined duration to be comprised between 20 and 150 ms.

the method may comprise a preliminary step of determining the high and low values, said preliminary step involving calculating the quantity ΔP/P for a plurality of identical stopped engines, and at a plurality of ambient temperatures.

Another subject of the invention is a computer program product, containing coded instructions for implementing the method according to the foregoing description, when it is implemented by a processing unit comprising a computer and a communications interface for communicating with the pressure sensors.

Another subject of the invention is a processing unit comprising a computer and a communications interface for communicating with the pressure sensors, the computer being configured to implement the method according to the foregoing description.

A final subject of the invention is an internal combustion engine comprising:

at least four cylinders, a set of cylinder-pressure sensors, which is configured so that throughout an engine combustion cycle, there is at least one cylinder in the compression or expansion phase the pressure of which is measured by a pressure sensor of the set.

a processing unit, comprising a computer and a communications interface for communicating with the pressure sensors, wherein the computer is configured to implement the method according to the foregoing description.

In one embodiment, the set of cylinder-pressure sensors is configured so that throughout an engine combustion cycle, there is at least one cylinder the pressure of which, measured by a pressure sensor of the set, is greater than at least 3 bar.

In one embodiment, the set of cylinder-pressure sensors comprises one cylinder-pressure sensor for each cylinder of the engine.

The proposed method relies on measuring the pressure of the cylinders during the compression and expansion phases of the engine cycle. This is because it is in these phases that the valves are closed. In the case where the engine has stopped, the pressure gradually decreases according to a law whereby the ratio $\Delta P/P$ is constant, this decrease being caused by leakage associated with the geometry of the engine and of the valves in particular.

As a result, by verifying whether this law is being respected it is possible to determine very rapidly and with certainty that the engine has stopped.

BRIEF DESCRIPTION OF THE DRAWINGS

Other features, objects and advantages of the invention will become apparent from the description that follows, which is purely illustrative and nonlimiting, and which must be read with reference to the appended figures, in which.

DESCRIPTION OF THE PREFERRED EMBODIMENTS

Figure 1:
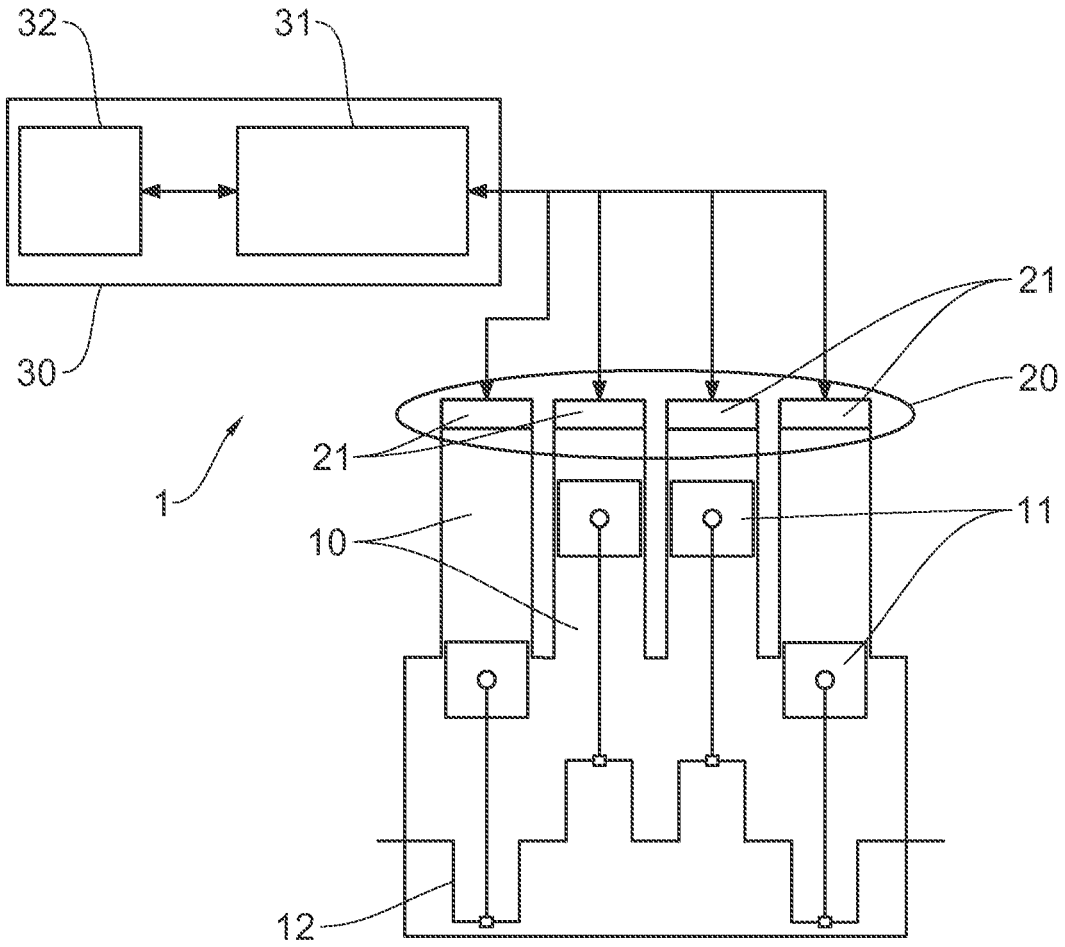
FIG. 1 schematically depicts one example of an internal combustion engine according to one embodiment of the invention.

Reference is made to FIG. 1 which schematically depicts an internal combustion engine 1 comprising at least four cylinders 10, in this instance four cylinders 10, each cylinder containing a piston 11 able to move in translation inside the cylinder, each piston 11 being driven by a crankshaft 12.

The internal combustion engine 1 also comprises a set 20 of cylinder-pressure sensors 21 which is described in greater detail hereinafter.

Finally, the internal combustion engine 1 also comprises a processing unit 30 comprising a computer 31, this computer being, for example, a processor, a microprocessor, or else a microcontroller, connected to the sensors 31, and a memory 32. Coded instructions are recorded in the memory 32, and executed by the computer 31, to implement the method described hereinafter for processing the data acquired by the pressure sensors 21.

The set 20 of cylinder-pressure sensors 21 is configured so that throughout an engine cycle, there is at least one cylinder in the compression or expansion phase the pressure of which is measured by one of the sensors 21 of the set. The number and the distribution of the sensors are consequently determined so as to obtain this result.

According to a first example depicted schematically in Table 1 below, the set of pressure sensors 21 comprises two pressure sensors for a total of four cylinders. The pressure sensors 21 are assigned respectively to two cylinders in phase opposition, namely that when one cylinder is in the intake phase, the other is in the expansion phase, and when the first is in the compression phase, the other is in the exhaust phase. The phases during which the pressure data acquired by a sensor are exploited for implementing the method for detecting the stoppage of the engine are indicated in bold type in the table.

TABLE 1

| Disposition of the sensors | | | |
|---|---|---|---|
| Cylinder 1 + sensor | Cylinder 2 | Cylinder 3 | Cylinder 4 + sensor |
| Expansion | Compression | Exhaust | Intake |
| Exhaust | Expansion | Intake | Compression |
| Intake | Exhaust | Compression | Expansion |
| Compression | Intake | Expansion | Exhaust |

As may be noted, this configuration of the set 20 of pressure sensors 21 makes it possible to ensure that there is always at least one sensor measuring the pressure in a cylinder the valves of which are closed.

Now, when the engine is physically stopped, the pressure in a cylinder the valves of which are closed decreases because of structural leakage associated with the valves which are not completely fluidtight, according to a law such that the ratio $\Delta P(t)/P(t)$ is constant, where $P(t)$ is the pressure in the cylinder at the instant t, and $\Delta P(t)$ is the variation in pressure in the cylinder at the instant t. This leakage may stem from the valve seat, but may also and especially be the result of leakage past the piston rings.

As will be described in greater detail hereinafter, this law is used to detect a stoppage of the engine, and so the fact that there is always one sensor measuring the pressure in a cylinder the valves of which are closed allows the method for detecting stoppage to be implemented throughout the engine cycle.

More preferentially still, the set 20 of pressure sensors 21 is configured in such a way that in addition, throughout the engine cycle, there is at least one cylinder in the compression or expansion phase the pressure of which is measured, this pressure being greater than a calibration pressure, for example of 3 bar. This guarantees the existence at each instant of a leakage that causes the pressure to decrease according to the law hereinbelow in a way that is measurable so that the method can be implemented.

Advantageously, in order to achieve this result, the set 20 of pressure sensors may comprise one sensor 21 per cylinder, as is the case depicted in FIG. 1 where there are four sensors 21.

For example, it is then possible at each instant to select the sensor which corresponds to a cylinder that is in a period of the engine cycle that extends from −90° to +90° crank angle with respect to the top dead center reached between compression and expansion.

Other configurations are possible, in which there may be a number of sensors that is lower than the number of cylinders.

A number of possible configurations for engines having at least four cylinders are summarized hereinbelow:

a set of at least 2 pressure sensors in an engine comprising four cylinders, a set of at least 3 pressure sensors in an engine comprising five cylinders, a set of at least 4 pressure sensors in an engine comprising six cylinders, or a set of at least 6 pressure sensors in an engine comprising 8 cylinders, etc.

It will be noted that there is no acceptable configuration for the set 20 of pressure sensors 21 for an engine comprising three cylinders because even with one sensor per cylinder, it is impossible to always have at least one cylinder in the compression or expansion phase.

Figure 2:
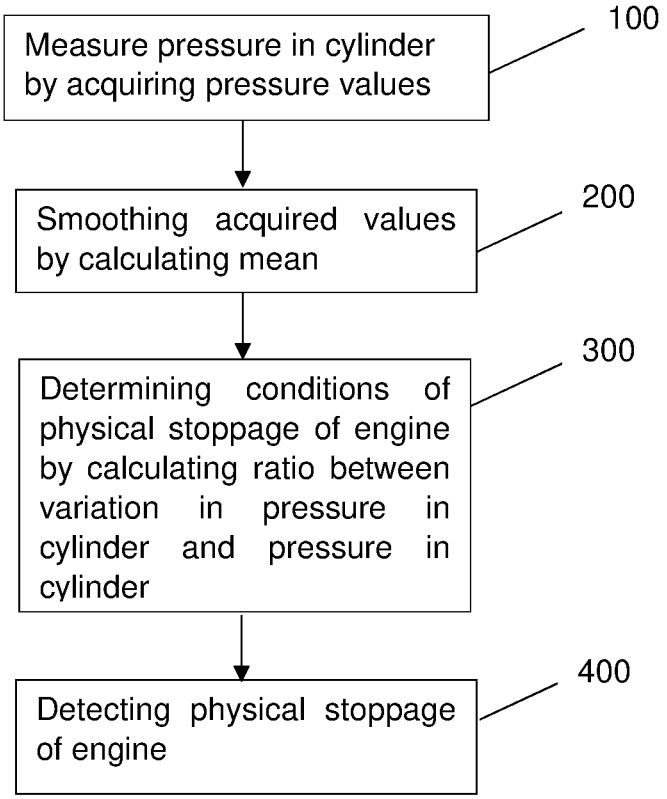
FIG. 2 schematically depicts the main steps of a method according to one embodiment of the invention.

The main steps of the method for detecting stoppage of the engine as described hereinabove will now be described with reference to FIG. 2.

The method comprises a first step 100 during which at least one of the pressure sensors 21 measures a pressure in a cylinder that is in a compression or expansion phase of the engine cycle. Advantageously, this step involves all the sensors 21 of the set 20 measuring the pressure in the respective cylinders.

Each sensor 21 is advantageously suited to acquiring a pressure measurement at a sampling frequency of at least 1 kHz, which corresponds to one measurement every millisecond. In one embodiment, each sensor is suited to acquiring a measurement every microsecond (sampling frequency of 1 MHz).

The method next comprises a step 200 of smoothing the values acquired. In order to do this, a mean is calculated across a set of the last N pressure measurements taken, so as to eliminate measurement noise. Advantageously, N is greater than or equal to 5, and for example equal to 10. This step is preferably performed on the values acquired by each of the sensors 21 of the set 20.

The method next comprises a step 300 of determining the conditions of physical stoppage of the engine. In order to detect the stoppage of the engine, two cumulative conditions need to be met simultaneously for at least one of the cylinder-pressure sensors that has acquired the measurements.

The first condition is that the pressure in the cylinder is decreasing. This is because if the pressure is increasing, that implies that the engine has not completely stopped, either because it is in a compression phase for the cylinder concerned, or because it is rebounding. This verification therefore makes it possible to avoid these two circumstances.

The second condition is that the quantity ΔP/P is constant. This is because, as described above, that implies that the decrease in pressure in the cylinder is associated only with air leaking from the cylinder and therefore that the engine has stopped.

Step 300 is implemented by calculating, from the smoothed pressure values obtained by each pressure sensor, the corresponding variation in pressure ΔP. This quantity is calculated for some of the smoothed data, namely at a period T that is greater than the time differential between two smoothed data. For example, the period T may be 10 ms.

If one iteration of calculating the quantity ΔP is denoted $T_N$, and the next iteration is denoted $T_{N+1}$, then the variation in pressure ΔP for the iteration N+1 is calculated as follows:

$$\Delta P(T_{N+1})=[P(T_N)-P(T_{N+1})],$$

and therefore the quantity ΔP/P for the iteration N+1 is calculated as follows:

$$\frac{\Delta P(T_{N+1})}{P(T_{N+1})}=\frac{[P(T_N)-P(T_{N+1})]}{P(T_{N+1})}.$$

In order to verify that the two conditions are being met, it is verified, on the one hand, that P is decreasing, namely that ΔP is less than 0, and, on the other hand, that ΔP/P is constant for a duration greater than a predetermined threshold.

In order to determine whether ΔP/P is constant over said duration, its value is compared against a window of values that is bounded by a high value and a low value. If the values of ΔP/P fall inside this window, namely they are comprised between the low value and high value, over said duration, then the quantity ΔP/P is considered to be constant.

The duration threshold is advantageously greater than or equal to 20 ms, which, according to the foregoing example, amounts to there being at least two successive values falling inside this window.

As a preference, for a more reliable determination, the duration threshold is advantageously greater than or equal to 100 ms, which corresponds to 10 successive iterations according to the foregoing example.

In order to allow rapid detection of the stoppage, it is nevertheless preferable for the duration threshold to be less than 150 ms, and preferably less than or equal to 100 ms.

The high and low values of the window within which the values of ΔP/P need to fall in order to detect a stoppage of the engine are advantageously determined during a preliminary calibration step. During this calibration step, the above-described calculation of ΔP/P is performed for one or a plurality of engines of identical model when stopped, and preferably for a plurality of ambient temperatures, and the high and low boundaries between which the value of ΔP/P must fall are determined. Advantageously, but optionally, the calibration step may also be implemented at different ambient-pressure values. In addition, the minimum threshold duration that allows a good compromise between the responsiveness of the method and the precision thereof may also be calibrated during this step. During the course of this same step, it is also possible to calibrate a threshold value for ΔP less than 0 which constitutes a margin of safety making it possible to ensure that the gradient is actually decreasing over the period considered.

If, for one of the pressure sensors of the set, the pressure P is decreasing and ΔP/P is constant for a duration greater than the calibrated threshold, then the method comprises a step 400 of detecting the physical stoppage of the engine.

According to one advantageous embodiment, the variation in pressure ΔP and the quantity ΔP/P are constantly calculated for all of the pressure sensors of the set, and when the two conditions regarding ΔP and ΔP/P are met for one of the pressure sensors then the stoppage of the engine is detected.

Figure 3A:
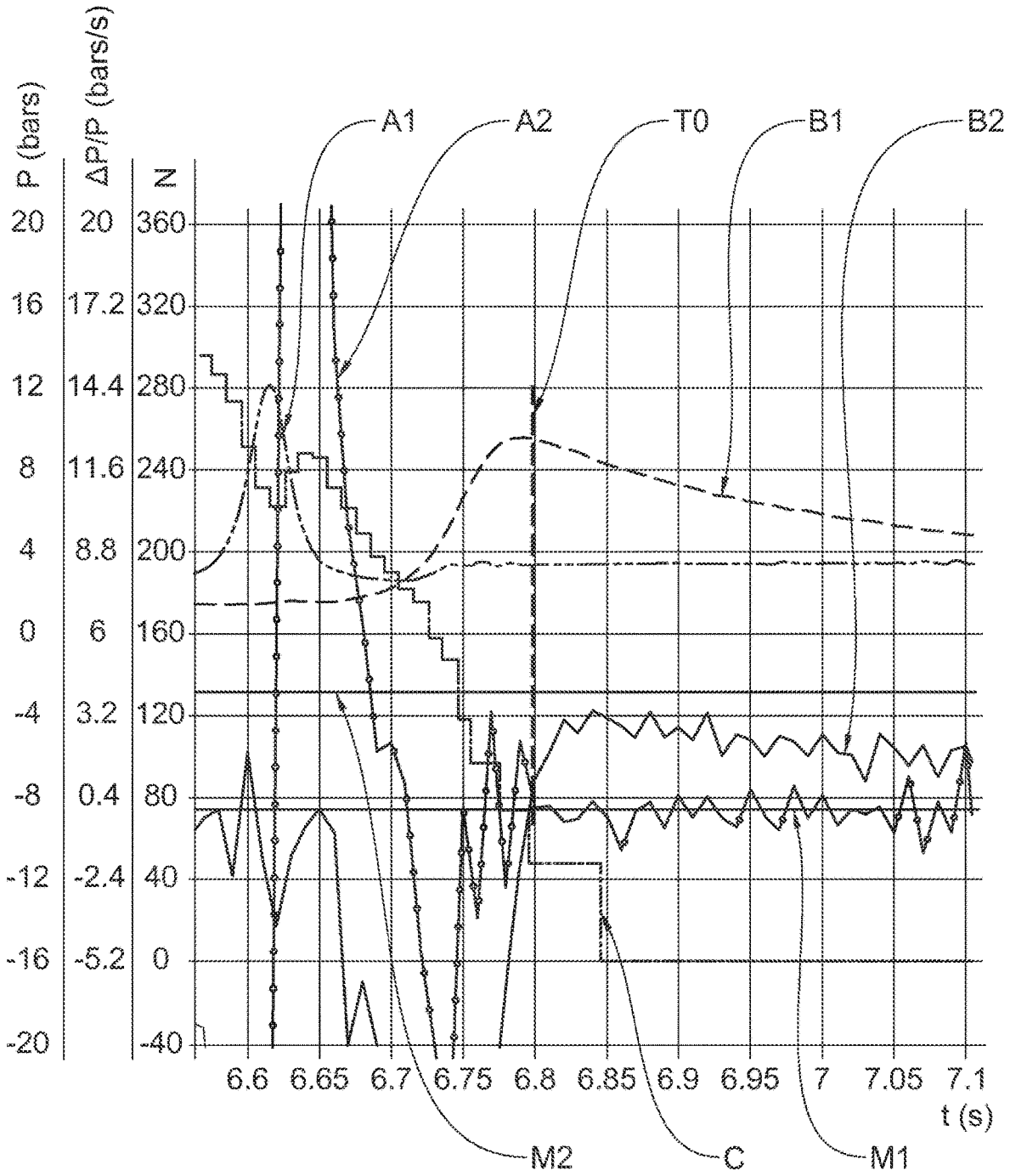
FIGS. 3*a* and 3*b* depict two examples of how the method can be implemented on two cylinder-pressure measurement curves.
Figure 3B:
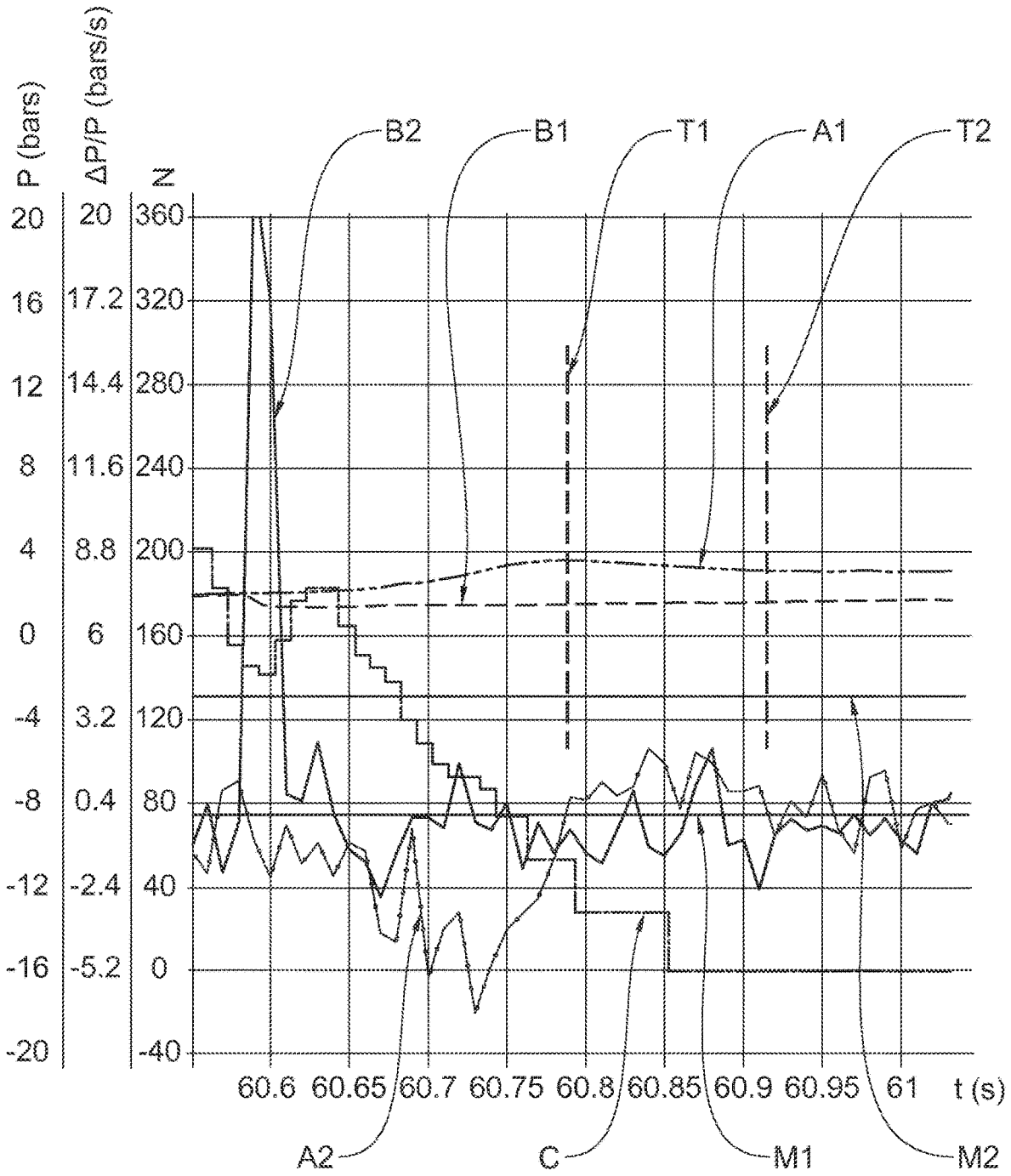

Two examples of how this method is implemented have been depicted in FIGS. 3*a* and 3*b*.

In these figures, curve A1 represents the smoothed pressure value in a first cylinder, and curve A2 represents the quantity ΔP/P in the same cylinder. Curve B1 represents the smoothed pressure value in a second cylinder, and curve B2 represents the quantity ΔP/P in the same cylinder. The straight lines M1 and M2 represent the high and low values of the window within which the values of ΔP/P need to fall in order to detect a stoppage of the engine.

Curve C represents the detection of the teeth of the crankshaft (ordinate N). The value of the curve is returned to 0 if, at the end of a timeout, no tooth has been detected. Consequently, the penultimate variation in value on curve C represents the last tooth encountered when the curve then returned to 0.

The abscissa axis represents the time (in seconds) and the ordinate axis represents the pressure P of the engine in bar for curves A1 and B1, and the value of ΔP/P in bar/s for curves A2, B2, M1 and M2.

In FIG. 3*a* it can be seen that during the expansion phase in the first cylinder, the pressure decreases but the quantity ΔP/P is not constant and does not fall inside the window represented by the straight lines M1 and M2. By contrast, a study of the quantity ΔP/P during the expansion phase in the second cylinder (in which the pressure is likewise decreasing) reveals that this quantity is substantially constant, namely falls within the window delimited by M1 and M2; starting from the time T0 indicated on the curve. Thus, engine stoppage is detected at the end of the threshold duration starting from the time T0, therefore for example 100 ms after T0. It may be seen from that same figure that the last crankshaft tooth is seen approximately 30 ms before the time T0, and so the stoppage of the engine occurs within the 30 ms preceding T0.

In FIG. 3*b*, it can be seen that a study of the quantity ΔP/P for the first cylinder makes it possible to detect an engine stoppage, even though the pressure in the cylinder is relatively low (under 4 bar). The period in which the quantity ΔP/P falls within the window delimited by M1 and M2 is identified by the times T1 and T2, and engine stoppage is detected at T1+100 ms, namely at around 60.89 s. It can be seen that thereafter the pressure value reached is too low for a leak with the constant quantity ΔP/P to persist, yet the duration for which this quantity is constant is sufficient to detect the stoppage of the engine.

The invention claimed is:

1. A method for detecting physical stoppage of an internal combustion engine (1) comprising:

at least four cylinders (10), a set (20) of cylinder-pressure sensors (21), which is configured so that throughout an engine combustion cycle, there is at least one cylinder (10) in the compression or expansion phase the pressure of which is measured by a pressure sensor (21) of the set (20), the method comprising:

the pressure in a cylinder (10) in the compression or expansion phase is measured, a ratio between a variation in pressure in the cylinder (10) and the pressure in the cylinder is calculated (400) from the pressure measured in the cylinder, and a physical stoppage of the engine is detected (500) if the measured pressure is decreasing and if the calculated ratio is constant.

2. The detection method as claimed in claim 1, wherein the step of measuring the pressure in a cylinder (10) comprises the acquisition (100) of pressure values at an acquisition frequency greater than or equal to 1 kHz, and the smoothing (200) of the acquired values.

3. The detection method as claimed in claim 1, wherein the step (400) of calculating the ratio between a variation in pressure in the cylinder and the pressure in the cylinder involves calculating, over a period T, the quantity $$\frac{\Delta P(T_{N+1})}{P(T_{N+1})} = \frac{[P(T_N) - P(T_{N+1})]}{P(T_{N+1})}$$

and comparing said quantity with high and low values, so that if the values of said quantity are comprised between said high and low values then said quantity is considered to be constant.

4. The detection method as claimed in claim 3, wherein a physical stoppage of the engine is detected when the quantity ΔP/P is comprised between the high and low values, and the pressure is decreasing over a determined duration.

5. The detection method as claimed in claim 4, wherein the determined duration is comprised between 20 and 150 ms.

6. The detection method as claimed in claim 3, comprising a preliminary step (90) of determining the high and low values, said preliminary step involving calculating the quantity ΔP/P for a plurality of identical stopped engines, and at a plurality of ambient temperatures.

7. A non-transitory computer-readable medium on which is stored a computer program, containing coded instructions for implementing the method as claimed in claim 1, when implemented by a processing unit (30) comprising a computer (31) and a communications interface (33) for communicating with the pressure sensors (21).

8. A processing unit (30), comprising a computer (31) and a communications interface (33) for communicating with the pressure sensors (21), said computer being configured to implement the method as claimed in claim 1.

9. An internal combustion engine (1) comprising:

at least four cylinders (10), a set (20) of cylinder-pressure sensors (21), which is configured so that throughout an engine combustion cycle, there is at least one cylinder (10) in the compression or expansion phase the pressure of which is measured by a pressure sensor (21) of the set (20), a processing unit (30), comprising a computer (31) and a communications interface (33) for communicating with the pressure sensors (21), wherein the computer (31) is configured to implement the method as claimed in claim 1.

10. The internal combustion engine (1) as claimed in claim 9, wherein the set (20) of cylinder (10) pressure sensors (21) is configured so that throughout an engine (1) combustion cycle, there is at least one cylinder (10) the pressure of which, measured by a pressure sensor (21) of the set (20), is greater than at least 3 bar.

11. The internal combustion engine (1) as claimed in claim 10, wherein the set of cylinder-pressure sensors comprises one cylinder-pressure sensor for each cylinder of the engine.

12. The detection method as claimed in claim 2, wherein the step (400) of calculating the ratio between a variation in pressure in the cylinder and the pressure in the cylinder involves calculating, over a period T, the quantity $$\frac{\Delta P(T_{N+1})}{P(T_{N+1})} = \frac{[P(T_N) - P(T_{N+1})]}{P(T_{N+1})}$$

and comparing said quantity with high and low values, so that if the values of said quantity are comprised between said high and low values then said quantity is considered to be constant.

13. The detection method as claimed in claim 4, comprising a preliminary step (90) of determining the high and low values, said preliminary step involving calculating the quantity ΔP/P for a plurality of identical stopped engines, and at a plurality of ambient temperatures.

14. The detection method as claimed in claim 5, comprising a preliminary step (90) of determining the high and low values, said preliminary step involving calculating the quantity ΔP/P for a plurality of identical stopped engines, and at a plurality of ambient temperatures.

15. A non-transitory computer-readable medium on which is stored a computer program, containing coded instructions for implementing the method as claimed in claim 2, when implemented by a processing unit (30) comprising a computer (31) and a communications interface (33) for communicating with the pressure sensors (21).

16. A non-transitory computer-readable medium on which is stored a computer program, containing coded instructions for implementing the method as claimed in claim 3, when implemented by a processing unit (30) comprising a computer (31) and a communications interface (33) for communicating with the pressure sensors (21).

17. A non-transitory computer-readable medium on which is stored a computer program, containing coded instructions for implementing the method as claimed in claim 4, when implemented by a processing unit (30) comprising a computer (31) and a communications interface (33) for communicating with the pressure sensors (21).

18. A non-transitory computer-readable medium on which is stored a computer program, containing coded instructions for implementing the method as claimed in claim 5, when implemented by a processing unit (30) comprising a computer (31) and a communications interface (33) for communicating with the pressure sensors (21).

19. A non-transitory computer-readable medium on which is stored a computer program, containing coded instructions for implementing the method as claimed in claim 6, when implemented by a processing unit (30) comprising a computer (31) and a communications interface (33) for communicating with the pressure sensors (21).

20. A processing unit (30), comprising a computer (31) and a communications interface (33) for communicating with the pressure sensors (21), said computer being configured to implement the method as claimed in claim 2.

* * * * *